United States Patent [19]

Yoshihara et al.

[11] 4,238,706

[45] Dec. 9, 1980

[54] SOFT X-RAY SOURCE AND METHOD FOR MANUFACTURING THE SAME

[75] Inventors: Hideo Yoshihara, Sekimachi; Mikiho Kiuchi, Asakusabashi; Satoshi Nakayama, Sayama; Toa Hayasaka, Tanashi; Junji Matsui, Tokyo, all of Japan

[73] Assignee: Nippon Electric Co., Ltd., Tokyo, Japan

[21] Appl. No.: 966,621

[22] Filed: Dec. 5, 1978

[30] Foreign Application Priority Data

Dec. 9, 1977 [JP] Japan ..... 52/147205

[51] Int. Cl.[3] ..... H01J 35/08

[52] U.S. Cl. ..... 313/330; 313/60; 250/492 A; 427/65; 427/160

[58] Field of Search ..... 313/330, 60, 55; 427/65, 93, 160; 250/492

[56] References Cited

U.S. PATENT DOCUMENTS

| | | | |
|---|---|---|---|
| 3,694,685 | 9/1972 | Houston | 313/330 |
| 3,721,847 | 3/1973 | Terasawa | 313/330 |
| 3,892,973 | 7/1975 | Coquin et al. | 250/505 |
| 4,119,879 | 10/1978 | Devine, Jr. | 313/330 |

*Primary Examiner*—Saxfield Chatmon, Jr.

*Attorney, Agent, or Firm*—Hopgood, Calimafde, Kalil, Blaustein & Lieberman

[57] ABSTRACT

There is disclosed a soft x-ray source comprising (a) a substrate formed of a thermally conductive material, such as copper or a copper alloy, which tends to generate predominantly hard x-rays upon the collision of an electron beam, (b) an intermediate layer formed on the substrate, the intermediate layer being at least one of rhodium, silver, palladium, and molybdenum, and (c) a silicon film formed on the intermediate layer. There is also disclosed an x-ray lithographic apparatus comprising (a) an electron beam source, (b) the soft x-ray source described above, and (c) means for irradiating an object with the emitted soft x-rays. The method for manufacturing the soft x-ray source comprises (a) preparing a substrate, (b) setting the substrate in a vacuum chamber, (c) introducing a gas or vapor-containing silicon in a vacuum chamber, and (d) forming a silicon film on the intermediate layer by generating a plasma within the vacuum chamber.

7 Claims, 6 Drawing Figures

SOFT X-RAY SOURCE AND METHOD FOR MANUFACTURING THE SAME

BACKGROUND OF THE INVENTION

1. Field of invention

The present invention relates to a soft X-ray source and a method for manufacturing the same, and more particularly, to a soft X-ray source to be used in an X-ray lithographic apparatus which is suitable for producing semiconductor devices and which has a high-power and highly stable X-ray output.

2. Description of the prior art

Prior to the emergence of X-ray lithography so-called photolithography was the preferred lithographic technique. Photolithography employs an ultraviolet ray emitted from a high pressure mercury vapor lamp and the like. Since a minute pattern on the order of a submicron is desired, photolithography can no longer maintain their proud standpoints because of the diffraction effect and the diffusion effect of an ultraviolet ray in the photo resist. X-ray lithography, on the other hand, employs rays which have a shorter wave length than ultraviolet rays.

In X-ray lithography a mask adapted to employ a shadow printing technique similar to that used in photolithography is placed between an X-ray source and an object to be exposed, and then X-ray flux is irradiated over the entire area of the mask. An X-ray-sensitive material film, namely an X-ray resist film, formed on the object is thereby selectively exposed to the X-ray, and a submicron pattern formed on the mask can be transferred to the object. An X-ray provides a greater penetrating power to a material than the electron beam or the photon and hence is not susceptible to scattering or reflection depending on the kinds of materials. Therefore, the X-ray lithography allows an increase in thickness of a resist, while retaining the desired resolution, and this leads to an improvement in reliability of an etching mask in a subsequent etching process. For a broad description of X-ray lithography, see U.S. Pat. No. 3,743,842 and "PROCEEDING OF THE IEEE" VOL. 62, NO. 10, OCTOBER 1974 from pages 1361 to 1387.

When semiconductor devices are manufactured by employing such an X-ray lithographic apparatus, if it is intended to enhance the production efficiency by reducing the exposure time to increase the yield of semiconductor devices per unit time, then it is necessary to get the soft X-ray at a high output.

For obtaining soft X-rays having high output and high density, water-cooled rotating X-ray sources are used as described, for example, by Hughes in SOLID STATE TECHNOLOGY (May 1977), at pages 39–42. The X-ray sources in the prior art are made of aluminum or comprised of a substrate made of copper or copper alloy through which water is circulated and a surface film made of aluminum formed on the substrate and emitting Al-K X-ray line having 8.3Å wavelength. However, the melting point of the aluminum is as low as 660° C., so that if the surface of the soft X-ray source is bombarded with a high energy electron beam for the purpose of obtaining higher output X-rays, then the aluminum or aluminum film will be molten or recrystallized, resulting in damage to the aluminum surface, and as a result, the X-ray output cannot be enhanced. For example, the recrystallizing temperature of aluminum which has a purity of 99.9% is 200° C., or lower, and as a result of measurement it has been confirmed that in the case of the water-cooled rotating X-ray source, the X-ray output begins to decrease at a range of 10 kW, or lower of the electron beam energy.

In order to remove this difficulty silicon, whose melting point is as high as 1410° C., has been used as the soft X-ray source. The Si-K X-ray line which has a 7.1Å wavelength has been used in X-ray lithography.

According to this method, it is considered that an effective output of X-rays will be enhanced by 2~3 times that which is obtained when aluminum is used for a soft X-ray source, because silicon has a performance which is more than twice as high as aluminum with respect to a melting point ratio, and because the transmittivity of X-rays through an X-ray output window made of beryllium of normally about 20 μm in film thickness and an X-ray exposure mask made of silicon of normally about 3 μm in film thickness, is improved by about 30~50% in comparison to aluminum.

However, in the past, mainly due to problems in working, silicon has not been used as a soft X-ray source, particularly in a water-cooled rotating X-ray source.

For instance, in case where aluminum is employed, it is possible to work it into a cylindrical form through the conventional machining process, and aluminum can be clad on a copper alloy having a high mechanical strength and then press-worked to form a double layer structure.

Since silicon is a brittle material, such a working process cannot be employed, but the method would be employed, in which, for instance, a copper alloy having a good thermal conductivity is worked into a cylindrical form and on its surface is formed a silicon film as by an evaporation process, a sputtering process or an ion-planting process.

However, according to the evaporation process or the sputtering process, the adhesion force between silicon and a copper or copper alloy is not sufficiently strong, and so, peeling off is apt to occur at these portions due to thermal deformation caused by electron beam bombardment. Furthermore, while the adhesive force itself of a silicon film formed by the ion-planting process is naturally sufficiently strong, the adhesion velocity in the case of making silicon film onto a substrate of a cylinder is so low that only an adhesion velocity of about 200Å/hr at the most is attainable, and therefore, if it is desired to make a silicon film of several microns or more adhere under such conditions it would take several tens hours and thus a silicon film is practice not available. In addition, if the thickness of the silicon film in this case is too thin, an electron beam having high energy would penetrate through the silicon film, and may generate hard X-rays from the underlying metal.

For instance, if a copper alloy containing chromium is used as the underlying metal or the substrate, then hard or nearly hard X-ray of 1.38 Å wavelength are generated from copper at an electron energy of about 9 kV or higher, and of 2.07 Å wavelength from chromium at an electron energy of about 6 kV or higher.

Therefore, it is necessary to suppress the generation of hard X-rays having high energy as much as possible because they will damage the semiconductor devices when they are exposed to them. For this reason also the silicon film cannot be made too thin.

In addition, since the generation efficiency of the Si-K X-ray line is proportional to the 1.67-th power of the accelerating voltage for the electron beam, when the silicon film is too thin and hard X-rays are liable to be generated, one must use the apparatus with a reduced accelerating voltage for the electron beam, and consequently, the X-ray output would be greatly lowered.

Furthermore, since the thermal conductivity of silicon is equal to 0.2 (cal/cam.deg.sec) which is smaller than the thermal conductivity of aluminum of 0.5 (cal/cm.deg.sec), the use of silicon is less advantageous than aluminum with respect to thermal dissipation. Thus if, thermal conductivity is represented by $\lambda$ and film thickness by d, thermal dissipation is considered to be proportional to $\lambda/d$, so that in order to obtain a value of $\lambda/d$ as high as that of aluminum, the thickness of the silicon film must be $\frac{1}{3}$ or less times the thickness of the aluminum film. Thus, if one tries to prevent a temperature rise at the surface of the silicon film because of the enhancement of the colliding electron beam energy for the purpose of obtaining a high output, by improving the thermal dissipation, then it is necessary to make the silicon target film as thin as possible.

On the other hand, however, as described above with respect to the prior art target structure, it is necessary to use a silicon film of 10 $\mu$m or more thickness in order to prevent generation of hard X-rays from copper and chromium in the underlying copper alloy. Furthermore, when the silicon film is made thicker as described above, the silicon film becomes more liable to peel off because of its thickness. This is disadvantageous in that the assembled X-ray source would be mechanically weak and would not have sufficient thermal dissipation.

Finally, if silicon is adhered directly onto a copper alloy, then mutual diffusion would occur between the copper and the silicon, and eventually at about 550° C. there occurs an eutectic reaction, resulting in a mixed structure consisting of silicon and an $\eta$-phase, which is not desirable for a soft X-ray source.

SUMMARY OF THE INVENTION

It is one object of the present invention to provide a highly stable high-output soft X-ray source that is free from the aforementioned disadvantages in the prior art.

Another object of the present invention is to provide a method for stably manufacturing the above-described effective soft X-ray source.

In one aspect, the present invention provides a soft X-ray source comprising (a) a substrate made of, for example, copper or copper alloy; (b) an intermediate layer formed on this substrate and selected from the group consisting of at least one of rhodium, silver, palladium and molybdenum, and (c) a silicon film formed on the intermediate layer. The intermediate layer may be constructed from multi-films in which each film is made of rhodium, silver, palladium or molybdenum.

In the above-described soft X-ray source, even if the silicon film is thin, hard X-rays would not be generated because of existence of the intermediate layer. Accordingly, taking into consideration the thermal dissipation and peeling off of the silicon layer, the silicon layer should preferably have a thickness of $1 \sim 10$ $\mu$m. In addition, since the intermediate layer does not form a solid solution with silicon, its thickness should be preferably 2000 Å $\sim 1$ $\mu$m, taking into consideration the range of electrons and the pin holes in the film. If the thickness of the intermediate layer comes within the above-referred region, the intermediate film can be adhered onto the substrate by conventional techniques such as, for example, wet plating, sputtering and ion-plating.

In another aspect, the present invention provides a method for manufacturing a soft X-ray source. This method comprises (a) preparing a substrate of a soft X-ray source on which an intermediate layer selected from the group consisting of at least one of rhodium, silver, palladium and molybdenum is formed, (b) setting the substrate in a vacuum chamber, (c) introducing a gas or vapor containing silicon in the vacuum chamber, and (d) forming a silicon film on the intermediate layer by a plasma generated with a high-frequency or D.C. voltage.

By employing such a plasma process, the silicon film may be tightly adhered onto the intermediate layer.

BRIEF DESCRIPTION OF DRAWINGS

Other objects, features and advantages will occur from the following description of a preferred embodiment and the accompanying drawings, in which:

Referring now to FIG. 1 of the drawings, within a vacuum envelope 16 are sealingly enclosed an electron beam source 18 and an X-ray source 11, an X-ray output window 17 for outputting soft X-rays 13 therethrough is disposed, and thereby a soft X-ray generating section is constructed.

Figure 1:
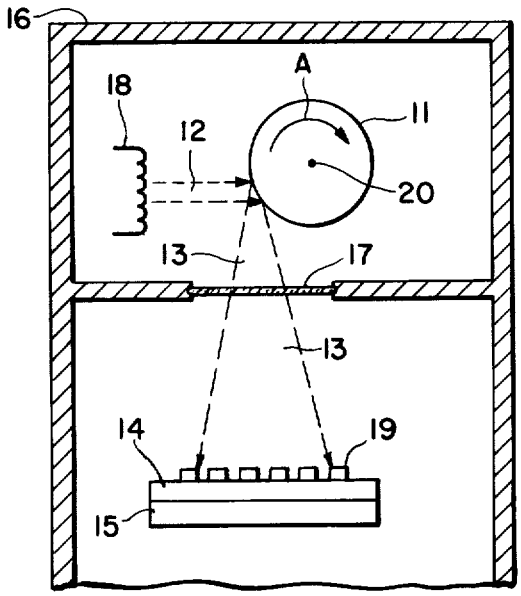
FIG. 1 is a schematic view showing a structure of an X-ray lithographic apparatus.

An electron beam 12 emitted from the electron beam source 18 is collided onto the surface of the X-ray source 11 which rotates about its axis 20 in the direction of arrow A marked in the figure, so that soft X-rays 13 are emitted from the surface of the source, and passed through the X-ray output window 17, and eventually arrive at the surface of a semiconductor wafer 15 on which an X-ray resist is applied and an X-ray exposure mask 14 is placed thereon. By means of these soft X-rays 13, the resist on the surface of the semiconductor wafer 15 is exposed to soft X-rays in accordance with a pattern 19 on the X-ray exposure mask.

Figure 2A:
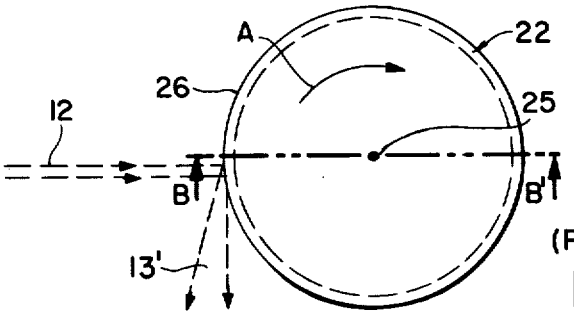
(PRIOR ART) FIG. 2A
FIG. 2A is a plan view showing a water cooled rotating X-ray source in the prior art.
Figure 2B:
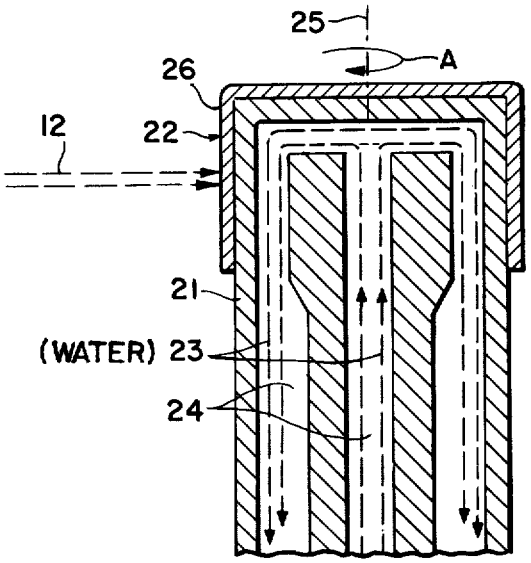
(PRIOR ART) FIG. 2B
FIG. 2B is a cross-sectional view taken along the line B–B′ as viewed in the direction of arrows of FIG. 2A.

A structure of a water-cooled rotating X-ray source in the prior art is illustrated in FIGS. 2A and 2B. As shown in the figures, an aluminum film 22 is coated on a substrate 21 of copper alloy, and within the substrate 21 a passageway 24 is formed and water 23 is circulated therethrough as a coolant. The X-ray source rotates about its axis 25 in the direction of arrow A in the figure. An electron beam 12 emitted from an electron beam source (no shown) is collided onto a peripheral surface 26, so that aluminum-K X-ray line 13′ is emitted.

PREFERRED EMBODIMENT

Figure 3A:
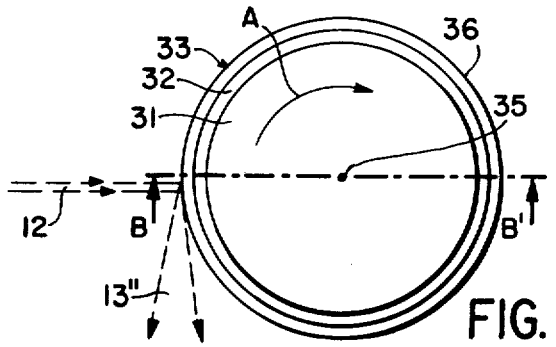
FIG. 3A is a plan view showing a structure of one preferred embodiment of the soft X-ray source according to the present invention.
Figure 3B:
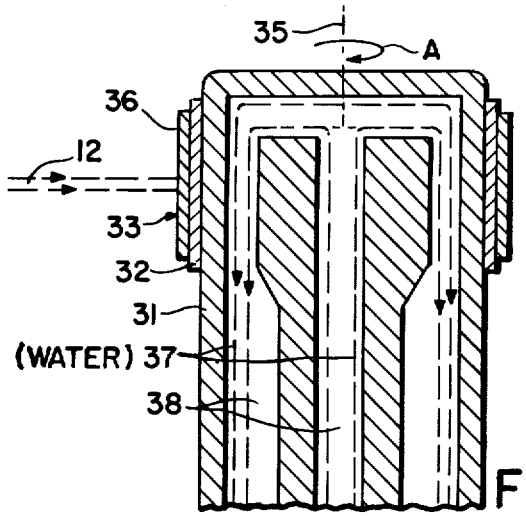
FIG. 3B is a cross-sectional view taken along the line B–B′ as viewed in the direction of arrows of FIG. 3A.

A structure of a soft X-ray source according to one preferred embodiment of the present invention is illustrated in FIGS. 3A and 3B. An intermediate layer 32 selected from the group consisting of at least one of rhodium, silver, palladium and molybdenum is provided on a substrate made of copper or copper alloy and a silicon film 33 is provided on the intermediate layer. The soft X-ray source is cooled by means of a passageway 38 and water 37 as a coolant from the back surface of the substrate 31. The X-ray source of this embodiment rotates about its axis 35 in the direction of arrow A. An electron beam 12 emitted from an electron beam source (not shown) is collided onto a peripheral surface 36, so that silicon-K X-ray lines 13'' are emitted.

In this embodiment, a copper alloy which has a relatively high thermal conductivity and a good machinability is worked into a cylindrical shape to form the substrate 31 of the soft X-ray source, and in view of heat dissipation and mechanical strength, the thickness of the substrate 31 is selected at 0.3~1 mm. On this substrate 31 is formed an intermediate layer 32 of molybdenum. The intermediate layer is selected from the group of at least one of ryodium, silver, palladium and molydenum. On the surface of the intermediate layer 32 there is formed a silicon film 33 of 1~10 μm thickness.

Various properties of the respective elements Rh, Ag, Pd, Mo, Cu and Cr are shown in TABLE-1 below.

Referring to TABLE-1, all the wavelengths of the hard X-ray generated by rhodium, silver, palladium and molybdenum are 0.62 Å or less, and even if it is irradiated with an electron beam of 20 KeV to 25 KeV, the amount of generation of the hard X-rays will be very small.

In addition, provided that the intermediate layer is formed to have a thickness of 1 μm, even if the intermediate layer should be directly irradiated with electrons of 25 KeV, the electrons would never reach the substrate containin copper or chromium.

TABLE 1

| | Properties | | | | |
|---|---|---|---|---|---|
| Elements | Thermal Conductivity (Cal/cm ·deg) | Hard X-ray Generating Voltage (KeV) | Hard X-ray Wavelength (A) | Range of Electrons at 25 KeV (μm) | Reaction State with Silicon and Reaction Temperature (°C.) |
| Rh | 0.20 | 23.2 | 0.534 | 0.89 | 1389 (Eutectic) |
| Ag | 1.00 | 25.5 | 0.486 | 1.19 | 830 (Eutectic) |
| Pd | 0.17 | 24.3 | 0.509 | 0.90 | 720 (Eutectic) |
| Mo | 0.34 | 20.0 | 0.620 | 1.08 | 1410 (Eutectic) |
| Cu | 0.94 | 9.0 | 1.380 | 1.23 | 558 (Eutectic) |
| Cr | 0.17 | 6.0 | 2.070 | 1.82 | 1330 Eutectic) |

On the other hand, the reaction temperatures of silicon with rhodium, silver, palladium and molybdenum, respectively, are 1389° C., 830° C., 720° C. and 1410° C. which are sufficiently high as compared to the recrystallization temperature of aluminum.

In the preferred embodiments of the present invention, the thickness of the silicon film is selected at 1~10 μm taking into consideration the heat dissipation of the silicon film and the projection range of electrons of 25 KeV.

Within this thickness region, the value of λ/d which is proportional to heat dissipation of silicon is $2\times10^3\sim2\times10^2$ Cal/cm$^2$·deg·sec, whereas the value of λ/d which is proportional to heat dissipation when a copper alloy is employed as an underlying metal and the thickness is selected at 0.3~1 mm is $3.1\times10\sim9.4$ Cal/cm$^2$·deg·sec. Accordingly, the value of λ/d which is proportional to heat dissipation of silicon is more than 200 times larger than that of the copper alloy, so that the heat dissipation of the silicon layer becomes negligible.

On the other hand, the projected range of electrons in silicon is 4.7 μm at 25 KeV and 3.6 μm at 20 KeV, and so, with regard to only the amount of electron energy absorbed by silicon, a thickness of about 5 μm is appropriate.

However, in the case of the present invention, since an intermediate layer which does not generate hard X-rays is employed, thickness of the silicon films can be made further thinner to about 1~3 μm.

With regard to the relation between the acceleration voltage of electrons and the thickness of the silicon film, for instance, in case where the acceleration voltage is 20 KV or lower a film thickness of 1~3 μm is suitable, in the case of 20~30 KV a film thickness of 5 μm, and in the case of 30KV or higher a film thickness of 5~10 μm is suitable.

In this way, by varying the thickness of the silicon film according to the acceleration voltage, it is possible to suppress the generation of hard X-rays and to achieve matching with the heat dissipation.

In addition, since the rhodium, silver, palladium and molybdenum used in the intermediate layer according to the present invention do not form a solid solution with silicon, then when determining the thickness of the intermediate layer it is only necessary to take into consideration the projected range of electrons and pin holes in the film. The thickness should be in the range of 2000 Å~1 μm.

So long as the film thickness falls in this region, the formation of the intermediate layer can be realized by employing the heretofore known process of wet plating, sputtering or ion-planting. In this connection, the thickness of the silicon film is favorably selected at the optimum value within the range of 1~10 μm depending upon the purposes of use or the like of the soft X-ray source.

As described above, since silicon would not make solid solution with rhodium, silver, palladium and molybdenum, if silicon is adhered onto the intermediate layer through a wet plating or sputtering process, the boundary surface between silicon and rhodium, silver, palladium or molybdenum would be subjected to abrupt structure change, and so, there would appear a state where all the stresses are concentrated at this boundary surface. In the Soft X-ray source having the above-described construction, a heat cycle will occur in such manner that at the driven state the temperature of the silicon film and the intermediate layer rises, while at the state of stopping the drive the temperature is lowered to room temperature. On the other hand, since the linear expansion coefficient of silicon, rhodium, silver, palladium and molybdenum are $1.5\times10^{-6}$, $8.5\times10^{-6}$, $19.1\times10^{-6}$, $11.6\times10^{-6}$ and $5.1\times10^{-6}$, respectively, there is a fear that a large stress may arise at the boundary surface between the silicon film and the intermediate layer resulting in peel-off of the silicon film.

Consequently, in such cases it is necessary to enhance the adhesive force of the silicon film by forcibly driving silicon atoms into rhodium, silver, palladium and/or molybdenum forming the intermediate layer. Such a method of ionizing silicon and partly driving the ionized silicon atoms into the intermediate layer to enhance the adhesive force of silicon, has been known as an ion-planting process. In the case of employing the ion-planting process, within a glow discharge in an inert gas, silicon is molten and vaporized by means of an electron beam or by electrical heating, and then partly ionized, and by making the ionized silicon adhere onto the intermediate layer with high energy it is possible to obtain a strong adhesive force.

However, as described previously, the ion-planting process has not a high adhesion velocity, and so, this approach is difficult in practice.

In the method for manufacturing of a soft X-ray source according to the present invention, a plasma deposition process for silicon is employed, in which supply of silicon and supply of a discharge-sustaining gas are simultaneously effected, and thereby the difficulty mentioned above can be eliminated.

Now the method for manufacture of a soft X-ray source according to the present invention will be described in detail in connection with a preferred embodiment.

Figure 4:
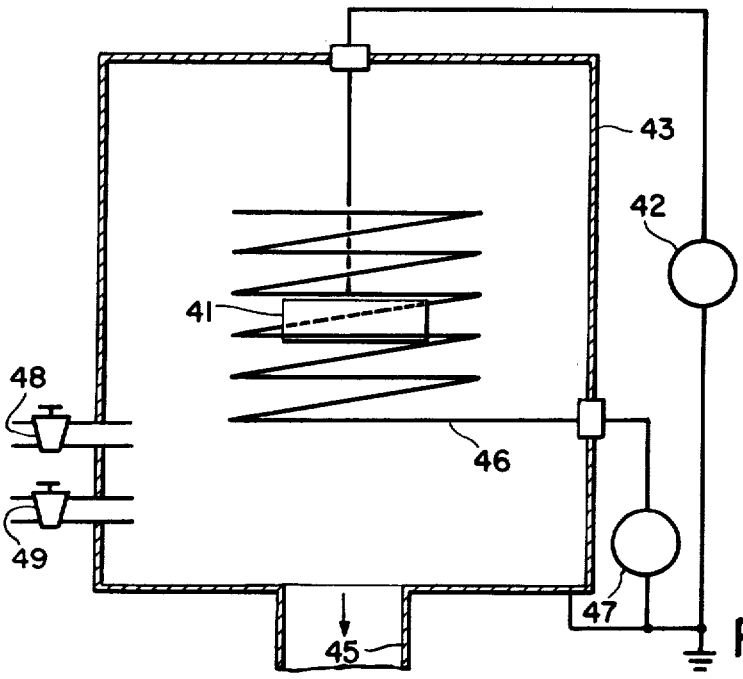
FIG. 4 is a schematic view showing the method for adhering silicon film in the process for manufacture of the soft X-ray source according to the present invention.

A principle of the process for depositing silicon in the method for manufacture of a soft X-ray source according to the present invention is illustrated in FIG. 4.

Within a vacuum chamber 43 is disposed a substrate 41 on which an intermediate layer has been formed, and around the substrate 41 of the soft X-ray source is provided a high frequency coil 46 connected to a high frequency power supply 47. In addition, the substrate 41 is connected to a high voltage D.C. power supply 42 and held at a predetermined potential. To the vacuum chamber 43 is connected an evacuation system connecting pipe 45 to create a predetermined vacuum therein, and also gas introduction valves 48 and 49 are connected to the chamber 43.

In this plasma deposition process for silicon, at first the interior of the vacuum chamber 43 is evacuated to the order of $10^{-5}$ Torr by making use of the evacuation system connecting pipe 45.

Next, a rare gas such as Ar, He, Ne, etc. is introduced into the vacuum chamber through the gas introduction valve 48 until a pressure of the order not exceeding $8\times10^{-3}$ Torr is attained, a negative high voltage of $-4$ KV is applied from the D.C. power supply 42 to the substrate 41 to generate glow discharge, and thereby effect sputter-cleaning of the substrate 41.

Thereafter, a silicon containing gas or vapor such as $SiH_4$, $SiCl_4$, etc. is introduced into the vacuum chamber 43 through the gas introduction valve 49, and the internal pressure is regulated at $5\times10^{-2}$ Torr or less.

Then the high frequency power supply 47 is switched on to induce high frequency discharge via the high frequency coil 46.

With this high frequency discharge, a plasma is generated within the vacuum chamber 43 to partly ionize silicon atoms, large kinetic energy is given to the silicon ions by the negative high voltage applied to the substrate 41, and thereby a silicon film of $1\sim10$ μm in thickness is formed on the surface of the intermediate layer which is selected from the group consisting of at least one of rhodium, silver, palladium and molybdenum.

In the method for manufacturing a soft X-ray source according to the present invention, silicon atoms are ionized within a plasma as described above, and owing to the potential difference generated by the power supply 42, the silicon ions would strike against the substrate with large kinetic energy, so that an extremely large adhesive force can be attained. Accordingly, even though silicon is adhered onto an intermediate layer which scarcely forms a diffusion layer with silicon, there would never occur peel-off of the silicon film.

In the case of the soft X-ray source according to the present invention, which has been manufactured by the method described above, it is possible to collide an electron beam of 20 KW (25 KV×800mA) or more for excitation of X-rays, and to obtain stable soft X-rays over a long period of time. It has been confirmed that at an acceleration voltage of 25 KV, generation of hard X-rays such as a Cu-K line is not recognized at all. Whereas, in case where an aluminum target is employed in the similar construction, the acceleration voltage is limited to 10 KV, and during a long period of drive an attenuation of output soft X-ray of the order of 5%/hr is recognized.

In this connection, as a result of measurement conducted by practically assembling the X-ray generating section employing the soft X-ray source having a silicon film according to the present invention in an X-ray lithographic apparatus, it has been confirmed that the exposure time can be reduced to about ⅓ with respect to the case where a target or X-ray source of aluminum is used.

As described in detail above, the soft X-ray source according to the present invention comprises an intermediate layer selected from the group consisting of at least one of rhodium, silver, palladium and molybdenum which is formed on a substrate, and a silicon film formed on the intermediate layer, and since this silicon film has a high melting point and a low vapor pressure and scarcely forms a diffusion layer with the intermediate layer, the obtained soft X-rays are of high power and highly stable.

In addition, according to the method for manufacturing a soft X-ray source of the present invention, a plasma is generated by making use of a silicon-containing gas or vapor introduced into a vacuum chamber, thereby silicon atoms are ionized and silicon ions having large kinetic energy of 4 KeV adhere onto the intermediate layer formed on the substrate, so that the adhesive force of silicon is large. And, the silicon is deposited onto an intermediate layer which scarcely forms a diffusion layer with silicon, so that peel-off the silicon film would not occur, and therefore, it is possible to provide a soft X-ray source which is mechanically ragged and excellent in physical properties.

We claim:

1. A soft x-ray source comprising (a) a substrate formed of a thermally conductive material which tends to generate predominantly hard x-rays upon the collision of an electron beam, (b) an intermediate layer formed on said substrate selected from the group consisting of at least one of rhodium, silver, palladium, and molybdenum, and (c) a silicon film formed on said intermediate layer.

2. The soft X-ray source of claim 1, wherein the thickness of said silicon film ranges from 1 μm to 10 μm.

3. The soft X-ray source of claim 1, wherein the thickness of said intermediate layer ranges from 2000 Å to 1 μm.

4. The soft X-ray source of claim 1, wherein a passageway of a coolant medium is provided within said substrate and said substrate is of rotary type.

5. An x-ray lithographic apparatus comprising (a) an electron beam source, (b) a soft x-ray source adapted to emit soft x-rays in response to collision of an electron beam emitted from said electron beam source against its surface, and (c) means for irradiating an object with the emitted soft x-rays, said soft x-ray source including (1) a substrate formed of a thermally conductive material which tends to generate predominantly hard x-rays upon the collision of an electron beam, (2) an intermediate layer formed on said substrate and selected from the group consisting of at least one of rhodium, silver, palladium, and molybdenum, and (3) a silicon film formed on said intermediate layer against which said electron beam collides.

6. A method for manufacturing a soft x-ray source comprising (a) preparing a substrate formed of a thermally conductive material which tends to generate predominantly hard x-rays upon the collision of an electron beam wherein there is formed on said substrate an intermediate layer selected from the group consisting of at least one of rhodium, silver, palladium, and molybdenum, (b) setting said substrate in a vacuum chamber, (c) introducing a gas or vapor containing silicon in said vacuum chamber, and (d) forming a silicon film on said intermediate layer by generating a plasma within said vacuum chamber whereby said silicon film is strongly adhered to said intermediate layer in the absence of solution of silicon and the material of said intermediate layer.

7. A soft x-ray source comprising (a) a substrate selected from the group consisting of copper and a copper alloy, (b) an intermediate layer formed on said substrate selected from the group consisting of at least one of rhodium, silver, palladium, and molybdenum, and (c) a silicon film formed on said intermediate layer in the absence of solution between said silicon film and the material of said intermediate layer.

* * * * *